United States Patent [19]

Sekine et al.

[11] Patent Number: 5,043,315

[45] Date of Patent: Aug. 27, 1991

[54] HEAT-SENSITIVE RECORDING MATERIAL

[75] Inventors: Mikiya Sekine, Warabi; Shigetoshi Hiraishi, Tokyo, both of Japan

[73] Assignee: Mitsubishi Paper Mills Limited, Tokyo, Japan

[21] Appl. No.: 607,666

[22] Filed: Nov. 1, 1990

[30] Foreign Application Priority Data

Nov. 6, 1989 [JP] Japan ..... 1-289719

[51] Int. Cl.[5] ..... B41M 5/30

[52] U.S. Cl. ..... 503/217; 503/216; 503/218

[58] Field of Search ..... 503/207, 216, 217, 218; 427/150-152

[56] References Cited

U.S. PATENT DOCUMENTS 4,521,793 6/1985 Kabashima et al. ..... 503/201

*Primary Examiner*—Bruce H. Hess

*Attorney, Agent, or Firm*—Cushman, Darby & Cushman

[57] ABSTRACT

A heat-sensitive recording material comprising a support and a heat-sensitive recording layer provided on the support, said heat-sensitive recording layer comprising an aromatic or heterocyclic isocyanate compound and an imino compound which reacts with the isocyanate compound to form color upon heating, said isocyanate compound being in the form of particles having an average diameter of 0.7-3.0 μm. With use of the heat-sensitive recording material, images sufficient in optical density for practical use can be printed.

2 Claims, No Drawings

HEAT-SENSITIVE RECORDING MATERIAL

This invention relates to a heat-sensitive recording material in which a specific heat-sensitive recording layer is provided on a support and which has an excellent image preservability and sensitivity.

Generally, heat-sensitive recording materials comprise a support having provided thereon a heat-sensitive recording layer comprising as essential components an electron donating, colorless dye precursor and an electron accepting color developer. Upon heating the heat-sensitive recording material by a thermal head, a thermal pen, a laser beam or the like, the dye precursor and the color developer instantly react with each other to give recorded images. Such heat-sensitive recording materials are disclosed in Japanese Patent Application Kokoku Nos. 43-4160, 45-14039 and the like.

When such heat-sensitive recording materials are used, records can be obtained by relatively simple apparatus, the maintenance of the apparatus is easy and no noise is made. Thus, the heat-sensitive recording materials are used in a wide variety of fields such as measuring recorders; facsimiles; printers; terminals of computers; labels; automatic vending machines for tickets and the like; etc.

The heat-sensitive recording mateirals in which an electron donating, colorless dye precursor and an electron accepting color developer are used are advantageous in that they have good appearance and soft feel, the color density obtained is high and various hues can be obtained. However, these materials have poor record preservability for the following reasons: When the recorded area comes into contact with plastics such as polyvinylchloride or the like, the records disappear on account of a plasticizer, an additive or the like contained in the plastics. When the recorded area comes into contact with an agent contained in a food or a cosmetic, the records disappear. The recorded images are easily discolored by sunlight exposure in a short time. At present, therefore, the use of the above heat-sensitive recording materials is limited to some fields. Thus, there has been strongly desired development of a heat-sensitive recording material free from these disadvantages.

Recently, high-speed printers have been developed which can carry out printing in a short time. Accordingly, heat-sensitive recording materials have required to have an excellent heat responsiveness and sensitivity so as to give printed images having sufficient density even when a small energy is applied for printing.

As heat-sensitive recording materials which give recorded images having high preservability by heating the two components contained therein to react with each other, there are disclosed heat-sensitive recording materials wherein the two components are an imino-compound and an isocyanate compound in, for example, Japanese Application Kokai Nos. 58-38733, 58-54085, 58-104959, 58-149388, 59-115887, 59-115888 and U.S. Pat. No. 4,521,793.

These heat-sensitive recording materials has a sufficient preservability of recorded images. However, they are poor in heat sensitivity and hence recorded image having sufficient density can hardly be obtained by high-speed printers.

The present inventors have conducted extensive research in order to develop a heat-sensitive recording material excellent in both image preservability and heat responsiveness. As a result, the above object can be attained by containing a specific, aromatic or heterocyclic isocyanate compound in a heat-sensitive recording layer.

According to the present invention, there is provided a heat-sensitive recording material comprising a support and a heat-sensitive recording layer provided on the support, said heat-sensitive recording layer comprising an aromatic or heterocyclic compound and an imino compound which reacts with the isocyanate compound to form color upon heating, said aromatic or heterocyclic isocyanate compound being in the form of particles having an average diameter of 0.7–3.0 μm.

This invention is described in detail below.

The heat-sensitive recording material comprises a support and a heat-sensitive recording layer (hereinafter referred to as "recording layer"). The recording layer comprises an aromatic or heterocyclic isocyanate compound, an imino compound and a binder.

The aromatic or heterocyclic isocyanate compound is in the form of particle having an average diameter of 0.7–3.0 μm. When the average diameter is more than 3.0 μm, larger energy is necessary for melting the particles so that the sensitivity of the heat-sensitive recording material becomes lower. When the average diameter is less than 0.7 μm, the surface area of the particles becomes larger so that the number of the isocyanate groups on the surface of the particles increases. As a result, more isocyanate groups lose its activity on account of the reaction with water when the particles are dispersed in water. Therefore, the number of the isocyanate groups which react with the imino compound upon heating is reduced, and hence the sensitivity of the heat-sensitive recording material becomes lower.

It has been generally believed that the sensitivity of a heat-sensitive recording material comprising an electron-donating, colorless dye precursor and an electron-accepting developer becomes higher when the diameter of the particles of each component is small. However, in case of a heat-sensitive recording material comprising an aromatic or heterocyclic isocyanate compound having very high reactivity and an imino compound, it has been found that the sensitivity of the heat-senstive recording material becomes high when the diameter of the particles of the isocyanate compound is in a specific range for the above reasons.

Incidentally, the smaller the particles of the imino compound which reacts with the isocyanate compound upon heataing, the higher the sensitivity of the heat-sensitive recording material.

The aromatic or heterocyclic isocyanate compound used in this invention is colorless or pale colored substances and solid at room temperature. Specifically, the aromatic or heterocyclic isocyanate compound includes 2,6-dichlorophenylisocyanate, p-chlorophenylisocyanate, 1,3-phenylenediisocyanate, 1,4-phenylenediisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, 2,5-dimethoxybenzene-1,4-diisocyanate, azobenzene-4,4'-diisocyanate, diphenyl ether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethylbiphenyl-4,4'-diisocyanate, 3,3'-dimethoxybiphenyl-4,4'-diisocyanate, diphenylmethane-4,4'diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate 4,4',4''-triisocyanato-2,5-dimethoxytriphenylamine, p-dimethylaminophenylisocyanate, tris(4-phenylisocyanato)-thiophosphate and the like. These isocyanate compounds may be used alone or in combination of two or more. If necessary, these may be used in the form of a so-called block isocyanate, which is an adduct with a phenol, a lactam, an oxime or the like. A dimer of diisocyanate such as a dimer of 1-methylbenzene-2,4-diisocyanate; an isocyanurate, which is a trimer of diisocyanate; and a polyisocyanate in which a polyol or the like is added to a diisocyanate may also be used.

One or more isocyanate compounds selected from the above is preliminarily dispersed in water containing a dispersing agent such as a water-soluble polymer, a polymer emulsion or a surfactant. This preliminary dispersion is pulverized in a dispersing machine such as a ball mill, sand mill, dyno mill, attritor, or colloid mill until the particles of the isocyanate compound has an average diameter of 0.7–3.0 μm. Thus, a dispersion is prepared.

As factors which determine the diameter of the particles, there may be mentioned the type of grinding medium, the diameter of the medium, the amount (proportion) of the medium charged into the dispersing machine, the rotational speed of the disc of the dispersing machine, the flow rate and temperature of the dispersion, the dispersing period, and the like. In order to control the diameter of the particles precisely, it is preferable to vary only the dispersing period while keeping the other factors as constant as possible.

The grinding medium used in this invention includes those for a ball mill such as steel ball (10–20 mm in diameter), porcelain ball (about 30 mm in diameter), or alumina ball (about 30 mm in diameter); those for a sand mill or dyno mill such as soda glass bead (0.1–5 mm in diameter), ottawa sand (10–50 mesh in diameter), silica bead (0.1–5 mm in diameter), or alumina bead (0.5–5 mm in diameter); those for an attritor such as steel ball (1–10 mm in diameter), soda glass bead (1–15 mm in diameter), alumina ball (1–15 mm in diameter, or mullite ball (1–15 mm in diameter).

In order to obtain particles small in diameter, it is generally preferable that small medium composed of a material high in density be filled in a large proportion. The diameter of the medium is preferably 10 mm or less, more preferably 5 mm or less. Moreover, it is also preferable that the disc of the dispersing machine rotate at a high speed, the flow rate of the dispersion be small, and the temperature of the dispersion be low.

The imino compound used in this invention is a compound which has at least one >C=CN group and is represented by the following formula:

$$\phi c = NH$$

wherein $\phi$ represents an aromatic compound residue which can form a conjugate system with C=N adjacent thereto. The imino compound is colorless or pale colored and solid at room temperature. If necessary, the imino compound may be used in combination of two or more. The imino compound includes 3-iminoisoindoline-1-one, 3-imino-4,5,6,7-tetrachloroisoindoline-1-one, 3-imino-4,5,6,7-tetrabromoisoindoline-1-one, 3-imino-4,5,6,7-tetrafluoroisoindoline-1-one, 3-imino-5,6-dichloroisoindoline-1-one, 3-imino-4,5,7-trichloro-6-methoxyisoindoline-1-one, 3-imino-4,5,7-trichloro-6-methylmercaptoisoindoline-1-one, 3-imino-6-nitroisoindoline-1-one, 3-iminoisoindoline-1-spirodioxolan, 1,1-dimethoxy-3-iminoisoindoline, 1,1-diethoxy-3-imino-4,5,6,7-tetrachloroisoindoline, 1-ethoxy-3-iminoisoindoline, 1,3-diiminoisoindoline, 1,3-diimino-4,5,6,7-tetrachloroisoindoline, 1,3-diimino-6methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo[3,4-b]pyrazine, 7-amino-2,3-diphenyl-5-oxopyrrolo[3,4-b]pyrazine, 1-iminonaphthalimide, 1-iminodiphenimide, 1-phenylimino-3-iminoisoindoline, 1-(3'-chlorophenylimino)-3-iminoisoindoline, 1-(2',5'-dichlorophenylimino)-3iminoisoindoline, 1-(2',4',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'dimethoxyphenylimino)-3-iminoisoindoline, 1-(2',5-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoyl-phenylimino)-3-iminoisoindoline, 1-(2'-chloro-5'-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicyanoimidazolyl-2'-imino)-3-imino-5,6-dimethy-1-4,7-pyradiisoindoline, 1-(cyanobenzoylmethylene)-3-iminoisoindoline, 1-(cyanocarboxamidomethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)-carbamoylmethylene]-3-iminoisoindoline, 1-[cyano-N-(4'-chlorophenyl)carbamoylmethylene]-3-iminoisoindoline, 1-[cyano-N-(4'-methoxyphenyl)carbamoylmethylene]-3-iminoisoindoline, 1-[cyano-N-(3'-chloro-4'-methylphenyl)carbamoylmethylene]-3-iminoisoindoline, 1-(cyano-p-nitrophenylmethylene)-3-iminoisoindoline, 1-(dicyanomethylene)-3-iminoisoindoline, 1-

(cyano1',2',4'-triazolyl-(3')-carbamoylmethylene)-3-iminoisoindoline, 1-(cyanothiazolyl-(2')-carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-[cyanobenzimidazolyl-2')methylene]-3-iminoisoindoline, 1-[(cyanobenzimidazolyl-2')-methylene]-3-imino-4,5,6,7-tetrachloroisoindoline, 1-[(cyanobenzimidazolyl-2')-methylene]-3-imino-5-methoxyisoindoline, 1-[(cyanobenzimidazolyl-2')methylene]-3-imino-6-chloroisoindoline, 1-[(1'-phenyl-3'-methyl-5-oxo)-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyradiisoindoline, 1-[(1'-methyl-3'-n-butyl)barbituric acid-5']-3-iminoisoindoline, 3-imino-1-sulfobenzimide, 3-imino-1-sulfo-6-chlorobenzoimide, 3-imino-1-sulfo-5,6-dichlorobenzimide, 3-imino-1-sulfo-4,5,6,7-tetrachlorobenzimide, 3-imino-1-sulfo-4,5,6,7tetrabromobenzoimide, 3-imino-1-sulfo-4,5,6,7tetrafluorobenzimide, 3-imino-1-sulfo-6-nitrobenzimide, 3-imino-1-sulfo-6-methoxybenzimide, 3-imino-1-sulfo-4,5,7-trichloro-6-methylmercaptobenzimide, 3-imino-1-sulfonaphthimide, 3-imino-1-sulfo-5-bromonaphthimide, 3-imino-2-methyl-4,5,6,7-tetrachloroisoindoline-1-one and the like.

The sensitiveity of the heat-sensitive recording material of this invention can be improved by using a co-dispersion of the imino compound and a metal soap as disclosed in Japanese Patent Application No. S63-263747 filed by the present applicant.

The metal soap is a metal salt of a acid such as a fatty acid, resin acid or naphthenic acid. Specifically, the acid includes caproic acid, caprylic acid, capric acid, lauric acid, myristic acid, palmitic acid, stearic acid, behenic acid, 12-hydroxystearic acid, ricinolic acid, linolic acid, oleic acid, abietic acid, neoabietic acid, d-pimaric acid, benzoic acid, cinnamic acid, p-oxycinnamic acid, polymethylene-carboxylic acid, and the like. The metal includes aluminium, manganese, cobalt, lead, calcium, iron, tin, magnesium, copper, zinc, nickel, and the like.

Preferably used is aluminium, zinc, tin, magnesium or calcium salt of a fatty or alicyclic carboxylic acid. Among them, especially preferable is zinc salt.

The metal salt is contained in an amount of, preferably 10–300% by weight, more preferably 30–200% by weight based on the weight of the imino compound.

The iminmo compound and metal soap are preliminarily dispersed in water containing a dispersing agent such as a water-soluble polymer, polymer emulsion or surfactant. The preliminary dispersion is pulverized in a dispersing machine such as a ball mill, sand mill, dyno mill, attritor or colloid mill until the average diameter of the imino compound particles becomes preferably 5 μm or less, more preferably 1.5 μm or less. Thus, the co-dispersion of the imino compound and metal soap is obtained. Incidentally, the diameter of the imino compound particles can be controlled in the same manner as in the case of the isocyanate compound.

The heat-sensitive recording layer may additionally comprise a heat-meltable substance to improve the sensitivity. The melting point of the heat-meltable substance is preferably 6°–180° C., more preferably 80°–140° C. The heat-meltable substance includes benzyl p-benzyloxybenzoate, stearamide, palmitamide, N-methylolstearamide, β-naphthyl benzyl ether, N-stearylurea, N,N'-distearylurea, phenyl β-naphthoate, phenyl 1-hydroxy-2-naphthoate, β-naphthyl p-methylbenzyl ether, 1,4-dimethoxynaphthalene, 1-methoxy-4-benzyloxynaphthalene, N-stearoylurea, 4-benzylbiphenyl, 1,2-di(m-methylphenoxy)ethane, 1-phenoxy-2-(4-chlorophenoxy)ethane, 1,4-butanediol phenyl ether, dimethyl terephthalate and the like.

These heat-meltable substances may be used alone or in combination of two or more. To obtain sufficient heat responsiveness, the heat-meltable substance is contained in an amount of, preferably 10–300%, more preferably 20–250%, by weight based on the weight of the isocyanate compound.

Furthermore, the heat-sensitive recording layer may further contain an aniline derivative having at least one amino group as disclosed in PCT/JP81/00300 filed by the present applicant. When the aniline derivative is contained, fogging is prevented more effectively.

Specifically, the aniline derivative includes methyl p-aminobenzoate, ethyl p-aminobenzoate, n-propyl p-aminobenzoate, iso propyl p-aminobenzoate, butyl p-aminobenzoate, dodecyl p-aminobenzoate, benzyl p-aminobenzoate, o-aminobenzophenone, m-aminoacetophenone, p-aminoacetophenon, m-aminobenzamide, o-aminobenzamide, p-aminobenzamide, p-amino-N-methylbenzamide, 3-amino-4-methylbenzamide, 3-amino-4-methoxybenzamide, 3-amino-4-chlorobenzamide, p-(N-phenylcarbamoyl)aniline, p-[N-(4-chlorophenyl)carbamoyl]aniline, p-[N-(4-aminophenyl)carbamoyl]aniline, 2-methoxy-5-(N-phenylcarbamoyl)aniline, 2-methoxy-5-[N-(2'-methyl-3'-chlorophenyl)carbamoyl]aniline, 2-methoxy-5-[N-(2'-chlorophenyl)carbamoyl]aniline, 5-acetylamino-2-methoxyaniline, 4-acetylaminoaniline, 4-(N-methyl-N-acetylamino)aniline, 2,5-diethoxy-4-(N-benzoylamino)aniline, 2,5-dimethoxy-4-(N-benzoylamino)anilin, 2-methoxy-4-(N-benzoylamino)-5-methylamiline 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenylsulfone, 2-chloro-5-N-phenylsulfamoylaniline, 2-methoxy-5-N,N-diethylsulfamoylaniline, 2,5-dimethoxy-4-N-phenylsulfamoylaniline, 2-methoxy-5-benzylsulfonylaniline, 2-phenoxysulfonylaniline, 2-(2'-chlorophenoxy)sulfonylaniline, 3-anilinesulfonyl-4-methylaniline, bis[4-(m-aminophenoxy)phenyl]sulfone, bis[4-(p-aminophenoxy)phenyl]sulfone, bis[3-methyl-4-(p-aminophenoxy)phenyl]sulfone, 3,3'-dimethoxy-4,4'-diaminobiphenyl, 3,3'-dimethyl-4,4'-diaminobiphenyl, 2,2'-dichloro-4,4'-diamino-5,5'-dimethoxybiphenyl, 2,2',5,5'-tetrachloro-4,4'-diaminobiphenyl, o-tolidinesulfone, 2,4'-diaminobiphenyl, 4,4'-diaminobiphenyl, 2,2'-dichloro-4,4'-diaminobiphenyl, 3,3'-dichloro-4,4'diaminobiphenyl, 2,2'-dimethyl-4,4'-diaminobiphenyl, 4,4'-thiodianiline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminodiphenylmethane, 3,4'-diaminodiphenylmethane, bis(3-amino-4-chlorophenyl)sulfone, bis(3,4-diaminophenyl)sulfone, bis(4-aminophenyl)sulfone, bis(3-aminophenyl)sulfone, 3,4'-diaminodiphenylsulfone, 3,3'-diaminodiphenylmethane, 4,4'-ethylenedianiline, 4,4'-diamino-2,2'-dimethylbenzyl, 4,4'-diamino-3,3'-dichlorodiphenylmethane 3,3'-diaminobenzophenone, 4,4'-diaminobenzophenone, 1,4-bis(4-aminophenoxy)benzene, 1,3-bis(4-aminophenoxy)benzene, 1,3-bis(3-aminophenoxy)benzene, 9,9-bis(4-aminophenyl)fluorene, 2,2-bis(4-aminophenoxyphenyl)propane, 4,4'-bis(4-aminophenoxy)diphenyl, 3,3',4,4'-tetraaminodiphenyl ether, 3,3',4,4'-tetraaminodiphenylsulfone, 3,3',4,4'-tetraaminobenzophenone, and the like.

The dispersion of the heat-meltable substance and/or aniline derivative can be prepared in the same manner as in the preparation of the dispersion of the aromatic or heterocyclic isocyanate compound.

The dispersion of the aromatic or heterocyclic isocyanate compound, the dispersion of the imino compound, and the dispersion of other components prepared above are mixed with one another to obtain a coating composition for heat-sensitive recording layer. The coating composition is coated on a support by a coating method such as air-knife coating, blade coating or curtain coating to form a heat-sensitive recording layer. Thus, the heat-sensitive recording material of this invention can be obtained.

As described above, the heat-sensitive recording material of this invention comprises a support having provided thereon a heat-sensitive recording layer which forms color upon heating. As the support, mainly used is paper; however, there can also be used various non-woven fabrics, synthetic resin film, laminated paper, synthetic paper, metal foil, a composite sheet consisting of a combination of them, or the like depending upon the purpose.

The heat-sensitive recording layer may have a single-layerd structure or multi-layerd structure. In case of multi-layered structure, an intermediate layer may be provided between each layer. Moreover, a protecting layer may be provided on the surface of the heat-sensitive recording layer. The heat-sensitive recording layer can be formed by coating the support with coating compositions obtained by mixing aqueous dispersions containing each coloring component pulverized therein, with the binder and the like. In this case, for example, each aqueous dispersion can be indivisually coated on the support to form multi-layered structure in which each layer contains one coloring component.

As the binder, there may be mentioned water-soluble binders such as starches, hydroxyethylcellulose, methylcellulose, carboxymethylcellulose; gelatin, casein, polyvinyl alcohol, modified polyvinyl alcohol, styrene-maleic anhydride copolymer and ethylene-maleic anhydride copolymer; latex type, water-insoluble binders such as styrene-butadiene copolymer, acrylonitrile-butadiene copolymer and methyl acrylate-butadiene copolymer; etc.

Furthermore, the heat-sensitive recording layer may contain a pigment such as diatomaceous earth, talc, kaolin, calcined kaolin, calcium carbonate, magnesium carbonate, titanium oxide, zinc oxide, silicon oxide, aluminium hydroxide, urea-formaldehyde resin, and the like.

For the purpose of prevention of head abrasion, sticking, and the like, if necessary, the heat-sensitive recording layer may further contain a metal salt of a higher fatty acid such as zinc stearate or calcium stearate; a wax such as paraffin, oxidized paraffin, polyethylene, oxidized polyethylene, stearamide or castor wax; a dispersant such as sodium dioctylsulfosuccinate; an ultraviolet-ray absorbent of benzophenone type, benzotriazole type or the like; a surfactant; a fluorescent dye; and the like.

The following Examples further illustrate this invention. Incidentally, the conditions for dispersing shown below are to be considered illustrative and not restrictive. Dispersing may be effected under any condition provided that the diameter of the isocyanate compound particles becomes in the range of 0.7–3.0 μm.

EXAMPLE 1

100 g of 4,4',4''-triisocyanate-2,5-dimethoxytriphenylamine was added to 400 g of a 2.5% aqueous solution of polyvinyl alcohol. The resulting mixture was dispersed for 4 hours in a sand mill having soda glass beads 0.8–1.2 mm in diameter under the following conditions:

| | |
|---|---|
| Proportion of the medium charged: | 60% |
| Rotational speed of the disc: | 650 m/min |
| Flow rate of the dispersion: | 400 ml/min |
| Temperature of the dispersion: | 35° C. |

The diameter of the dispersed particles was measured by Mircotrac SRA (manufactured by Leeds and Northrup Instruments). As a result, the average diameter was 0.70 μm.

Apart from the above, 150 g of 1,3-diimino-4,5,6,7-tetrachloroisoindoline as the imino compound and 150 g of zinc stearate as the metal soap were added to 700 g of a 8.5% aqueous solution of polyvinyl alcohol. The resulting mixture was dispersed in a sand mill to obtain a co-dispersion of the imino compound.

200 g of 2-benzyloxynaphthalene was added to 800 g of a 2.5% aqueous solution of polyvinyl alcohol and dispersed in the same manner as stated above.

The three dispersion obtained above were mixed with one another and stirred enough. To the resulting mixture were added 1,250 g of a 40% dispersion of calcuium carbonate and 1,500 g of a 5% aqueous solution of polyvinyl alcohol and stirred enough to obtain a coating composition.

The coating composition obtained above was coated on a sheet of base paper having a basis weight of 50 $g/m^2$ so as to form a coating layer in a proportion of 5.0 $g/m^2$ in terms of solid content. Thus coated paper was dried and subjected to a supercalender treatment to obtain a heat-sensitive recording material.

On the heat-sensitive recording material, printing was carried out by a facsimile printing tester at an applied voltage of 11.00 V and an applied pulse width of 1.4 ms. The optical density of the image printed above was measured by a Macbeth RD-918 type densitometer.

EXAMPLES 2–8 AND COMPARATIVE EXAMPLE 1–3

The same procedure as in Example 1 was repeated, except that the isocyanate compound was dispersed in the sand mill for the period shown in Table to obtain particles of the isocyanate compound having the diameter shown in Table.

As is clear from the results shown in Table, with use of the heat-sensitive material of this invention, printed images having a sufficient optical density for practical use can be obtained. However, Comparative Examples 1–3 do not give printed images having a sufficient optical density, because the diameter of the isocyanate compound particles is not in the range of 0.7–3.0 μm.

TABLE

| | Dispersing period, hour | Average diameter, μm | Optical density |
|---|---|---|---|
| Example 1 | 4 | 0.70 | 1.01 |
| Example 2 | 3 | 0.77 | 1.08 |
| Example 3 | 2.5 | 0.92 | 1.09 |

TABLE-continued

| | Dispersing period, hour | Average diameter, μm | Optical density |
|---|---|---|---|
| Example 4 | 2.0 | 0.99 | 1.13 |
| Example 5 | 1.25 | 1.54 | 1.10 |
| Example 6 | 1 | 1.72 | 1.13 |
| Example 7 | 0.75 | 2.14 | 1.10 |
| Example 8 | 0.5 | 2.90 | 1.01 |
| Comparative | | | |
| Example 1 | 6 | 0.60 | 0.81 |
| Example 2 | 5 | 0.64 | 0.88 |
| Example 3 | 0.25 | 3.47 | 0.80 |

What is claimed is:

1. A heat-sensitive recording material comprising a support and a heat-sensitive recording layer provided on the support, said heat-sensitive recording layer comprising an aromatic or heterocyclic isocyanate compound and an imino compound which reacts with the isocyanate compound to form color upon heating, said isocyanate compound being in the form of particles having an average diameter of 0.7–3.0 μm.

2. A heat-sensitive recording material according to claim 1, wherein the isocyanate compound has been dispersed in a dispersing machine selected from the group consisting of a ball mill, sand mill, dyno mill, attritor and colloid mill.

* * * * *